US010836619B2

(12) United States Patent
Rossato

(10) Patent No.: US 10,836,619 B2
(45) Date of Patent: Nov. 17, 2020

(54) METHOD FOR THE SET-UP AND CONTROL OF A LIFT SYSTEM

(71) Applicant: O.ME.R. S.p.A., Mirano (IT)

(72) Inventor: Orietta Rossato, Mirano (IT)

( * ) Notice: Subject to any disclaimer, the term of this patent is extended or adjusted under 35 U.S.C. 154(b) by 0 days.

(21) Appl. No.: 16/300,568

(22) PCT Filed: May 18, 2017

(86) PCT No.: PCT/IB2017/052944
§ 371 (c)(1),
(2) Date: Nov. 11, 2018

(87) PCT Pub. No.: WO2017/199204
PCT Pub. Date: Nov. 23, 2017

(65) Prior Publication Data

US 2019/0144248 A1 May 16, 2019

(30) Foreign Application Priority Data

May 18, 2016 (IT) ..... UA2016A003564

(51) Int. Cl.

| | |
|---|---|
| ***B66F 3/46*** | (2006.01) |
| ***B66F 7/20*** | (2006.01) |
| ***B66F 7/04*** | (2006.01) |
| ***B66F 7/10*** | (2006.01) |
| ***B66F 7/14*** | (2006.01) |

(52) U.S. Cl.
CPC ..... *B66F 3/46* (2013.01); *B66F 7/04* (2013.01); *B66F 7/20* (2013.01); *B66F 7/10* (2013.01); *B66F 7/14* (2013.01)

(58) Field of Classification Search
CPC ..... B66F 3/46; B66F 7/20; B66F 7/04; B66F 7/10; B66F 7/14
USPC ..... 269/17; 254/2 B, 89 H; 187/210, 234, 187/247, 277
See application file for complete search history.

(56) References Cited

U.S. PATENT DOCUMENTS

| | | | | |
|---|---|---|---|---|
| 7,025,178 | B2 * | 4/2006 | Wengelski | B60S 9/12 187/244 |
| 2004/0026180 | A1 * | 2/2004 | Baker | B66F 3/46 187/285 |

(Continued)

FOREIGN PATENT DOCUMENTS

| | | |
|---|---|---|
| WO | 2004024612 | 3/2004 |
| WO | 2015005772 | 1/2015 |

*Primary Examiner* — Lee D Wilson
*Assistant Examiner* — Seahee Hong
(74) *Attorney, Agent, or Firm* — Themis Law

(57) ABSTRACT

Method and related system to set-up and control a system for lifting loads, preferably motor vehicles, includes causing the user to be positioned at each column to be registered as belonging to the system and to provide an activation command in the user interface of each column to register it as belonging to the lifting system, the user interface providing no information to the user about the position of that column in relation to the other columns and to the load. The user then moves each registered column to any of the operating positions for lifting the load; by acting on the user interface of one of the registered columns, assigns to that column the role of command column; and commands, by acting on the user interface of the command column, the simultaneous lifting/lowering of at least one or all the columns of the lifting system.

16 Claims, 6 Drawing Sheets

(56) References Cited

U.S. PATENT DOCUMENTS

Figure 1:
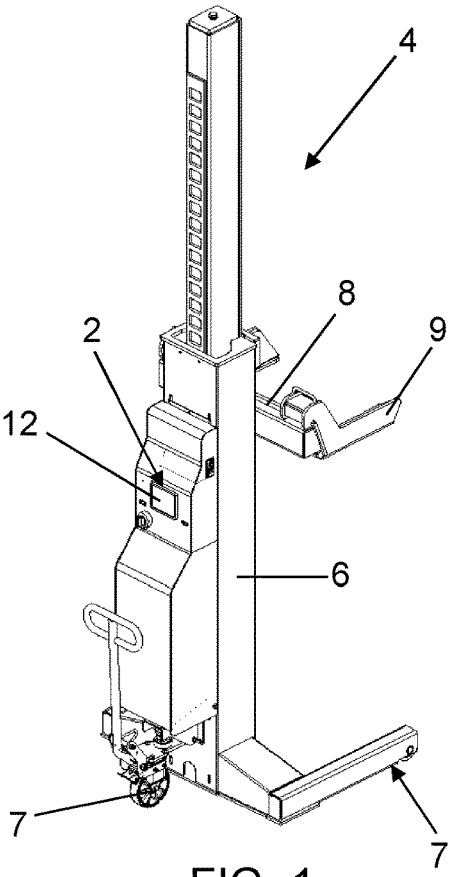

| | | | | |
|---|---|---|---|---|
| 2005/0045429 | A1* | 3/2005 | Baker | B66F 3/46 187/277 |
| 2006/0115353 | A1* | 6/2006 | Berends | B66F 3/46 414/458 |
| 2006/0182563 | A1* | 8/2006 | De Jong | B66F 3/46 414/427 |
| 2007/0088463 | A1* | 4/2007 | Green | B66F 7/04 700/275 |
| 2007/0096068 | A1* | 5/2007 | Finkbeiner | B66F 7/20 254/45 |
| 2009/0236183 | A1 | 9/2009 | Bordwell | |
| 2013/0240300 | A1 | 9/2013 | Fagan | |
| 2015/0307334 | A1* | 10/2015 | Van Houten | B66F 7/20 700/213 |

* cited by examiner

METHOD FOR THE SET-UP AND CONTROL OF A LIFT SYSTEM

The present invention relates to an improved method for the set-up and control of system for lifting loads, preferably motor vehicles. Moreover, the present invention relates to a lifting system which is set up and controlled according to said process, and also to a mobile lifting column with improved user interface and suitable for forming part of said lifting system. Equipment for lifting motor vehicles is known, which is generally used in workshops in order to allow the users' access to the lower areas of the motor vehicles themselves to perform maintenance operations and/or repairs.

Among the known lifting equipment for motor vehicles, there are those consisting of a plurality of mobile columns which are mechanically independent, but are electronically connected to and in communication with one another via cable or wirelessly.

In particular, each mobile column comprises a vertical support along which there slides vertically a carriage provided with horizontal arms for engaging the corresponding areas of the motor vehicle to be lifted. The column is also provided with actuation means, for example of the electromechanical or hydraulic type, for lifting/lowering the carriage with respect to the vertical support, and also with a suitable control system and an interface display with the user.

Against such a background, US 2009/0236183 proposes a lifting system in which each column of the system is provided with an interface with a display screen in which there is depicted the position of each column with respect to the other columns of the system and with respect to the vehicle; in particular to this end, all the columns of the system are depicted graphically in the display screen about a suitable graphic symbol which depicts the vehicle. Therefore, the user thereby may recognize the relationship of the columns both with one another and with respect to the vehicle from the interface of an individual column in order to select and control them without having to associate an identification number with them and without having to verify where they are physically positioned.

In particular, to register a column in the lifting system, the user selects a corresponding button on the command interface of each column which is graphically associated with and representational of the position of that column with respect to the vehicle.

Thus, in such a system, once the lifting system has been set up (that is, the columns have been registered as forming part of such a system), the positioning of each column with respect to the others and with respect to the vehicle is mandatory and always is to be the same, also in the case of repositioning the system on other vehicles.

For example, if when a new column is registered in the lifting system, it is associated with the operating position at the front right wheel, such a relationship always is to be kept also for any further and successive use of the lifting system thus defined. In other words, every time that system is used, that column always is to be positioned at the front right wheel of the vehicle to be lifted, and this also applies to all the position relationships defined for all the other columns of the system.

It is easy to sense how such a registration method does not facilitate and quicken the repositioning from one vehicle to another of the columns forming part of that lifting system.

In this known system, once the lifting system has been configured, groups of simultaneously activable columns may also be created, which however consist of a minimum of two aligned/opposite columns only with respect to a transverse axis of the vehicle.

WO2015/005772 describes a lifting system with at least two columns and provided with an external control system (remote control) common to all columns. In particular, the user acts on such an external and centralized control system by means of an identification key in order to select the columns forming part of the lifting system.

US2013/240300 describes a lifting system with at least two columns which wirelessly communicate with each other and which, when they are powered on, automatically verify if there are new columns to be added.

WO2004/024612 describes a lifting system with at least two columns provided with a card holder for the insertion of an identification card. In such a solution, the master column is to be registered first, and furthermore the particular sequence with which the other columns are associated with the master column defines a unique identification code of each column with respect to the others.

It is the object of the invention to propose an improved method for setting up and controlling a system for lifting loads, preferably motor vehicles, which is improved and/or an alternative with respect to the traditional ones.

It is another object of the invention to propose a method in which the initial positioning and/or the successive operations of repositioning each column, both with respect to the others and with respect to the vehicle, are in no manner mandatory and predefined.

It is another object of the invention to propose a method in which the positioning sequence of the various columns, both respect to the others and with respect to the vehicle, may be completely free, random and different each time.

It is another object of the invention to propose a method in which, once a system having mobile columns is set up, such a system is quickly and easily transferable from one vehicle to be lifted to another.

It is another object of the invention to propose a method in which any one group of columns which are simultaneously controllable, may be defined among all the columns in the system itself.

It is another object of the invention to provide a mobile lifting column with a user interface which is simple to implement and is quick, easy and intuitive to be used.

It is another object of the invention to provide a mobile lifting column with a user interface which facilitates the user during the step of aligning/realigning the columns.

It is another object of the invention to provide a lifting system with mobile columns for lifting motor vehicles which overcomes the drawbacks of traditional systems and is simple, quick and intuitive to be created, set up and controlled.

It is another object of the invention to provide a lifting system with mobile columns which warns the user of a misalignment condition of one or more columns of the system itself.

It is another object of the invention to provide a lifting system with mobile columns which has an alternative characterization with respect to traditional ones, both in constructional and functional terms.

It is another object of the invention to provide a lifting system with mobile columns which can be made in a simple and quick manner and with low costs.

All these objects are achieved according to the invention by a method with the features indicated in claim 1, by a mobile column with the features indicated in claim 10, and by a lifting system with the features indicated in claim 26.

Figure 2:
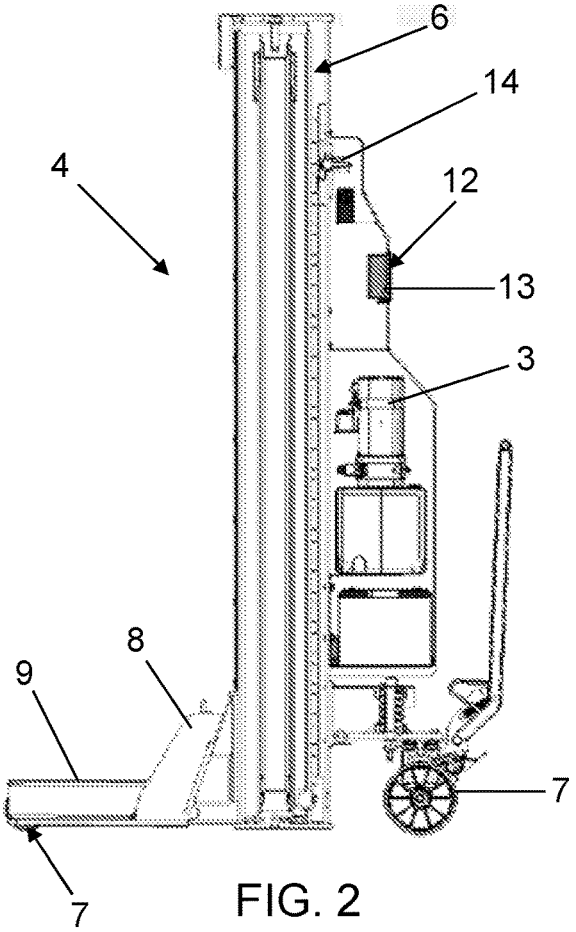
Figure 3:
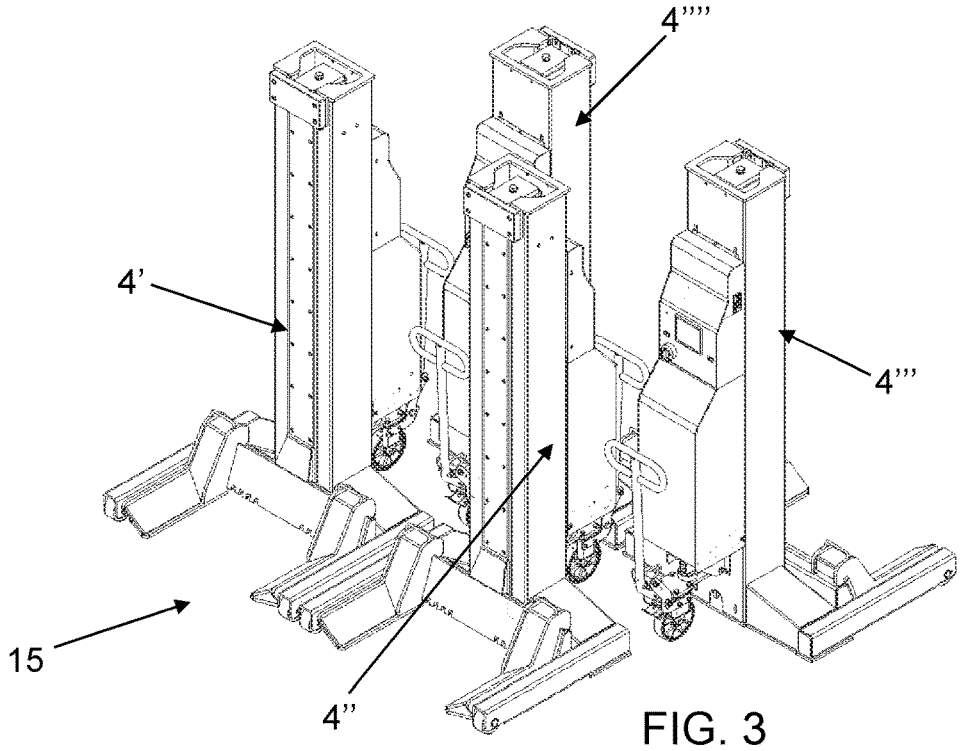
Figure 4:
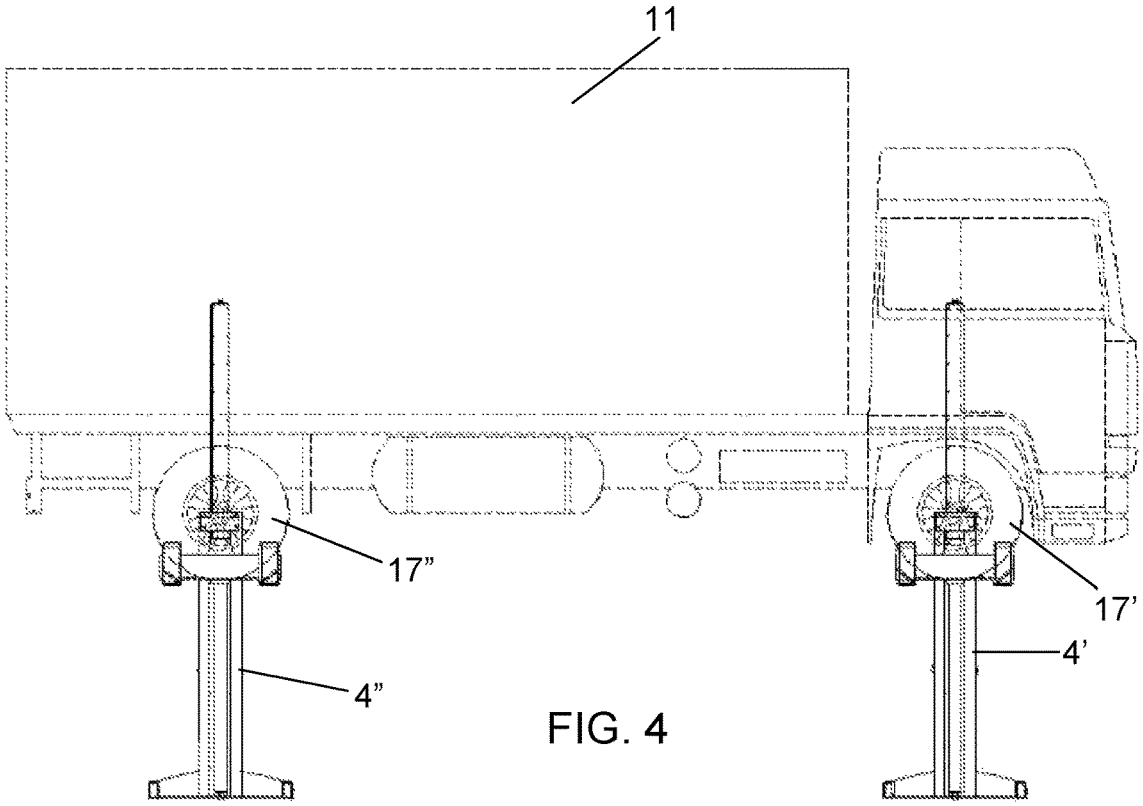
Figure 5:
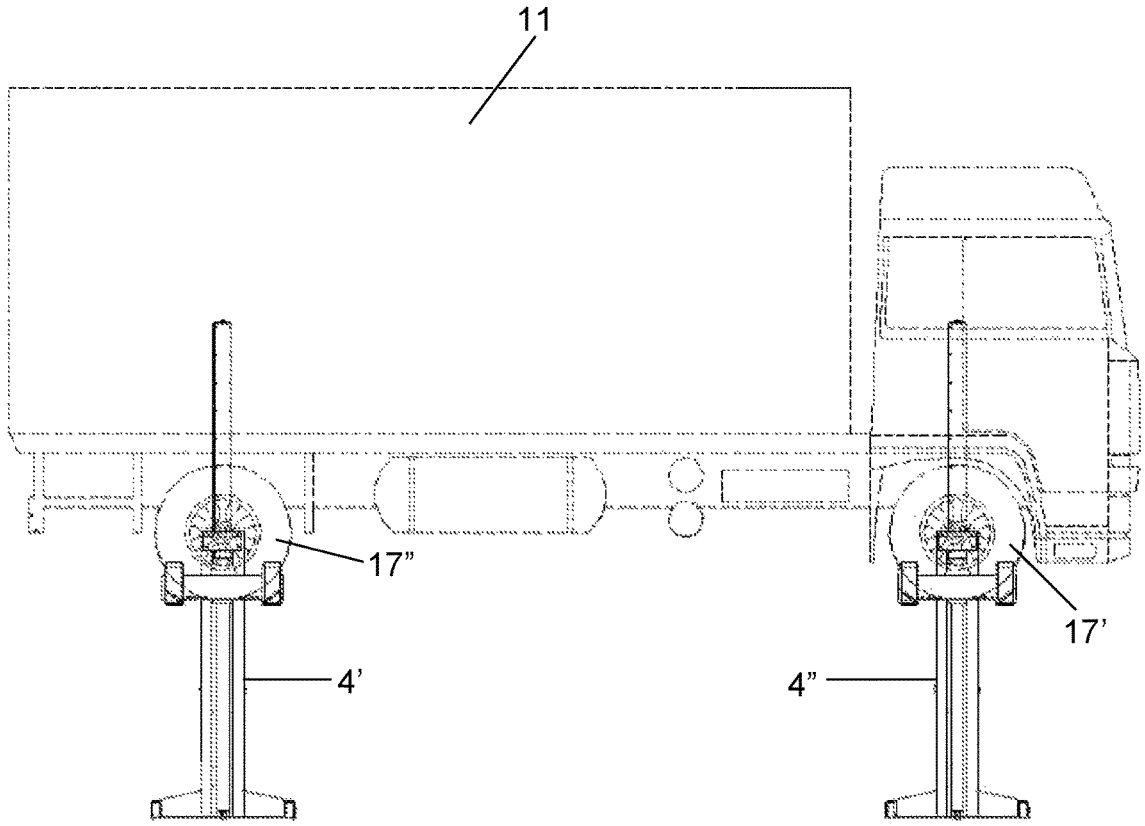
Figure 6:
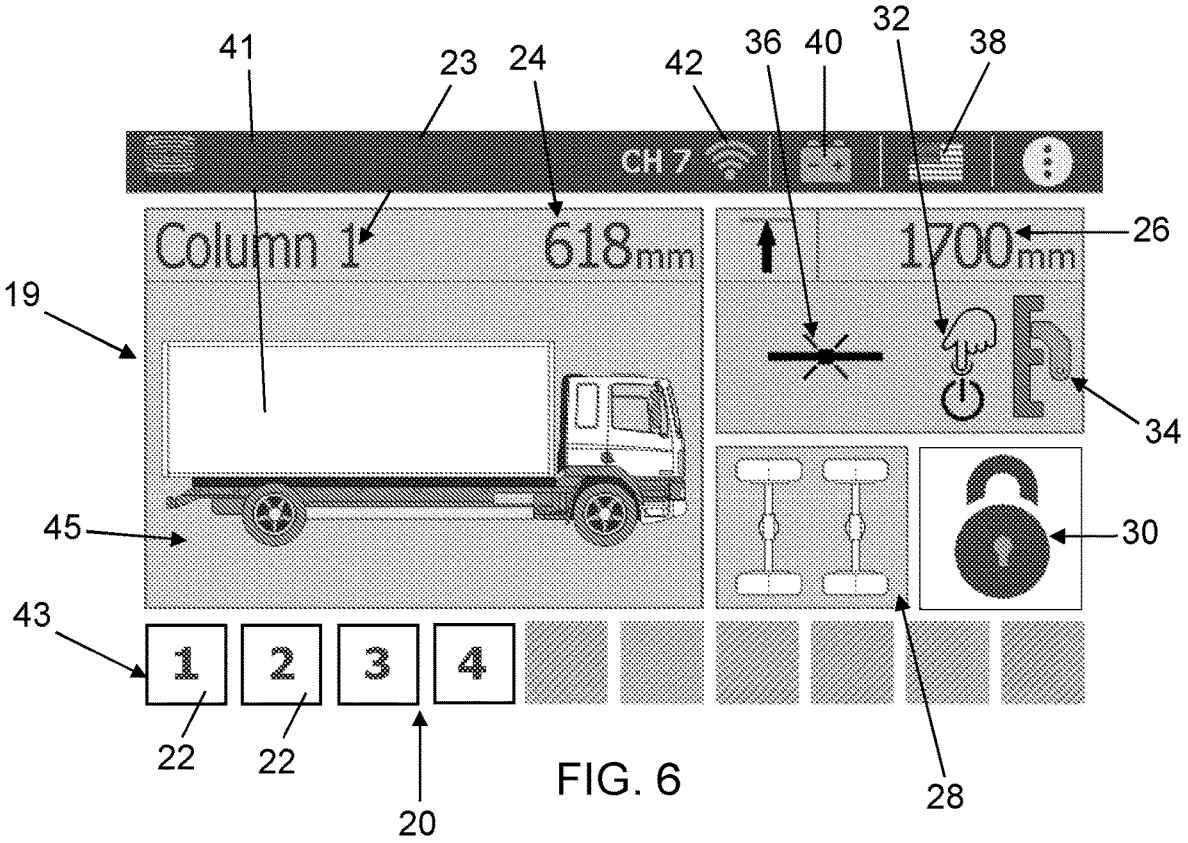
Figure 7:
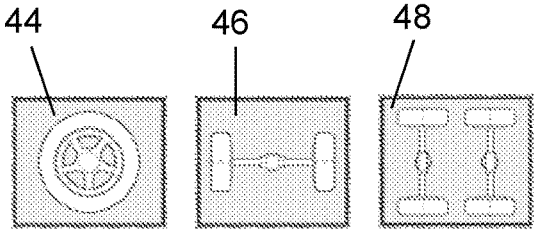
Figure 8:
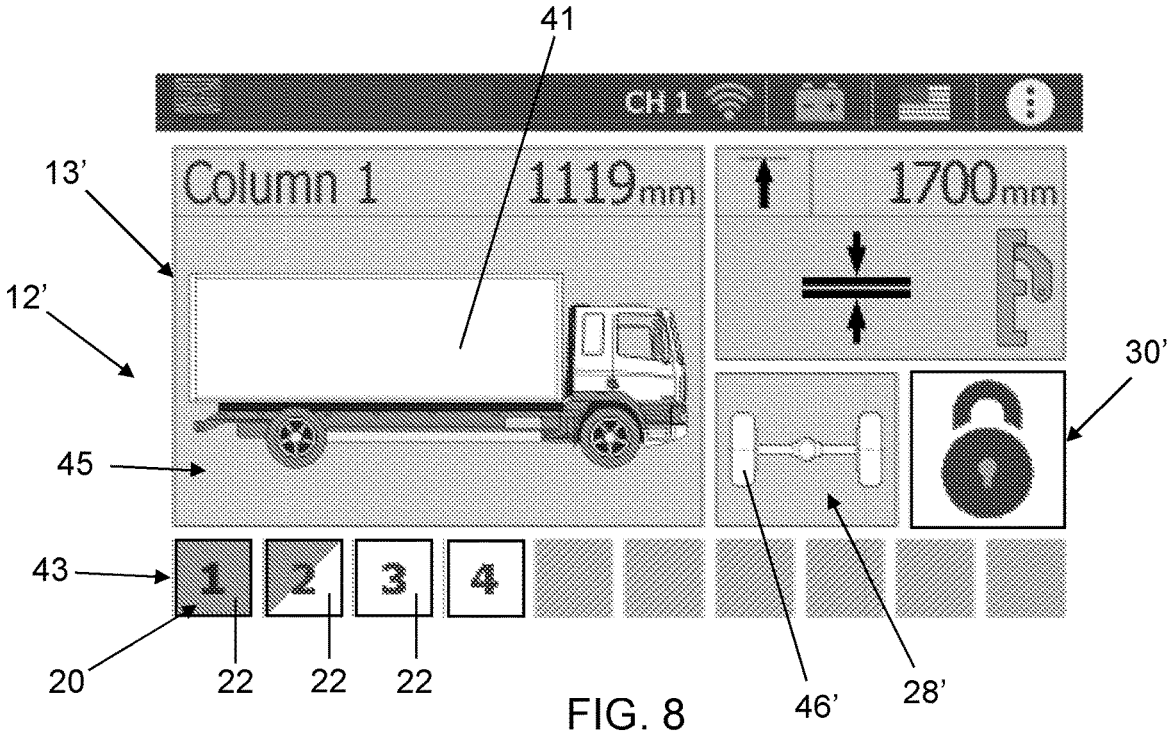
Figure 9:
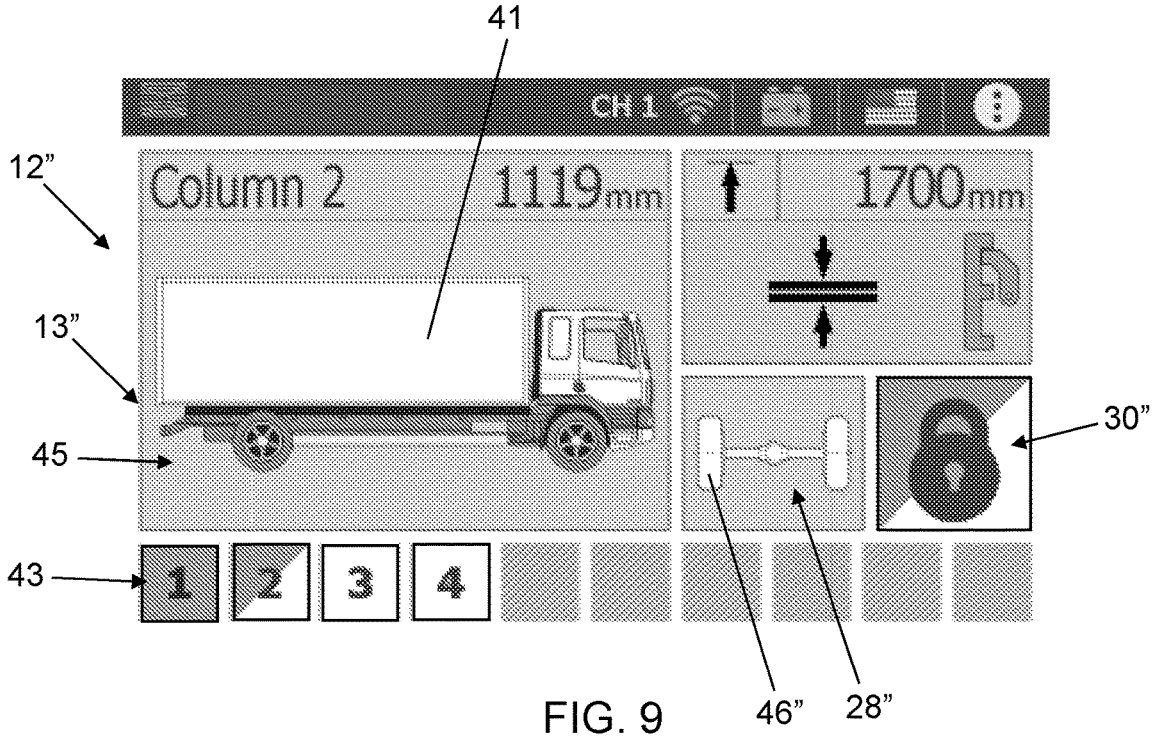
Figure 10:
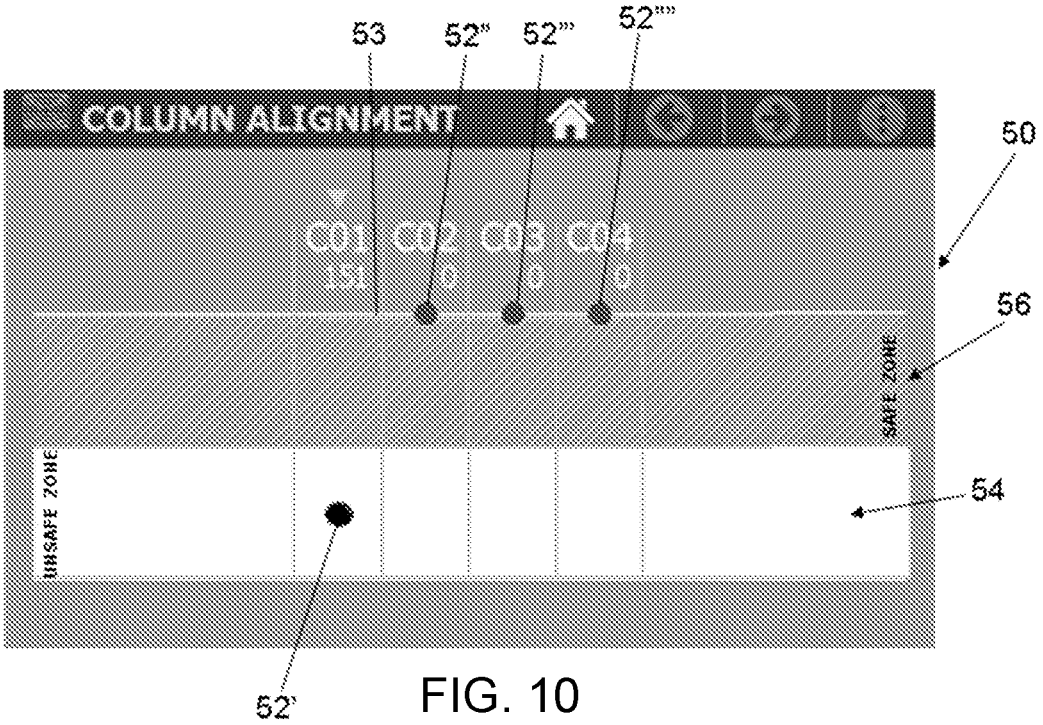
Figure 11:
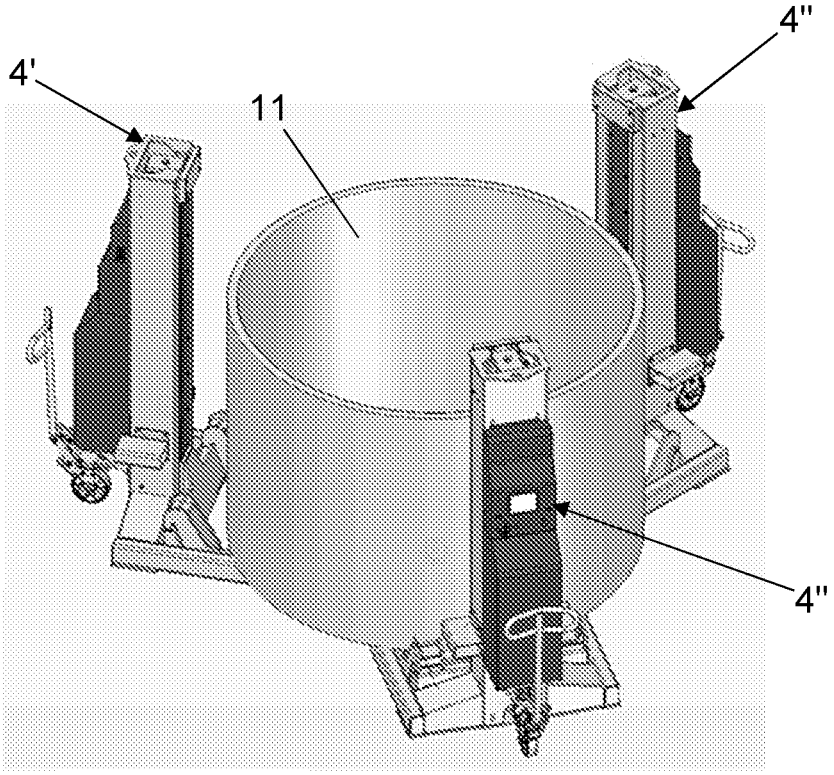
Figure 12:
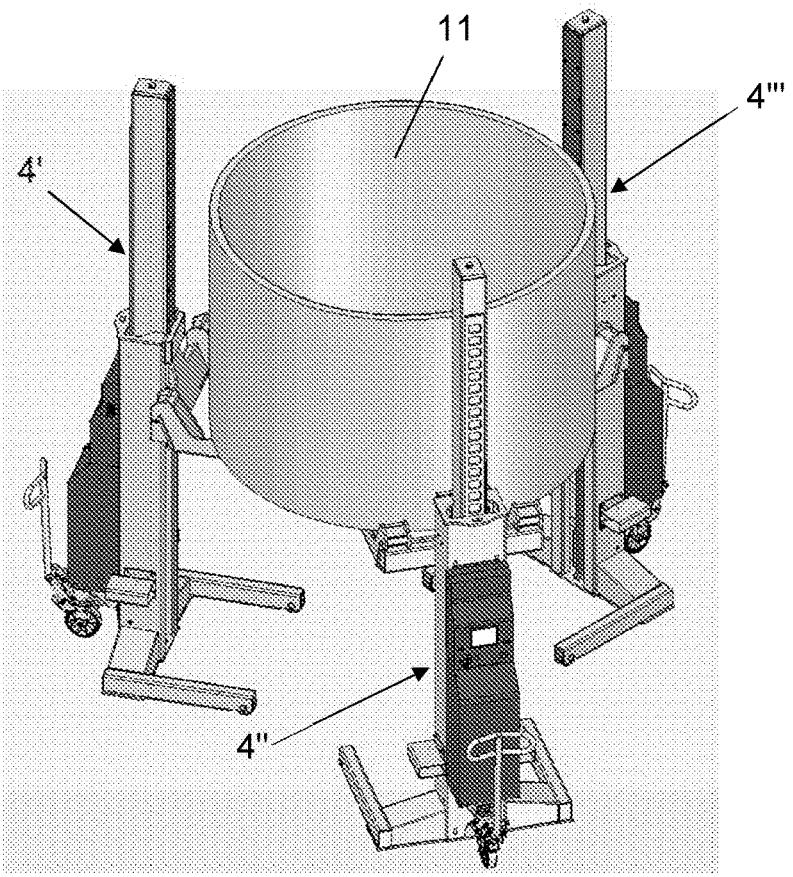
Figure 13:
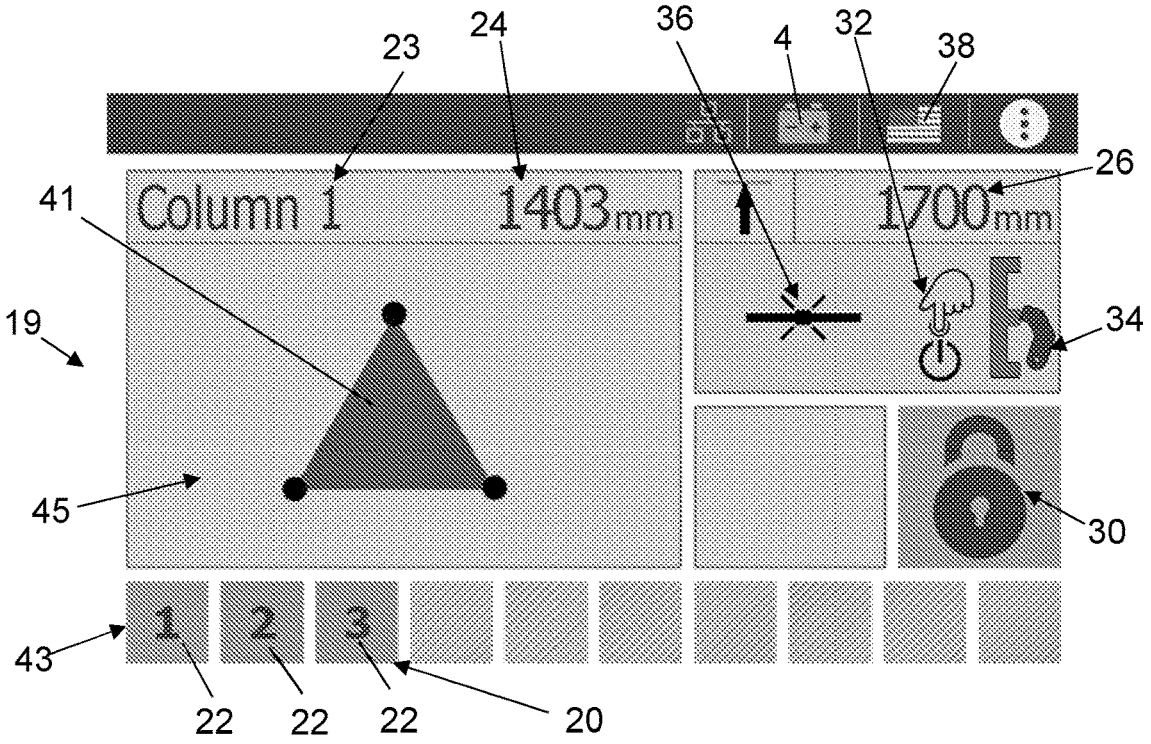

The present invention is further clarified below in certain preferred embodiments thereof, indicated by mere way of non-limiting example with reference to the accompanying drawings, in which:

FIG. 1 shows a perspective view of a mobile column according to the invention, FIG. 2 shows a sectional vertical view thereof, FIG. 3 shows a perspective view of a plurality of lifting columns before the set-up/creation of the lifting system, FIG. 4 shows a side view of the lifting system according to the invention, in operating condition, with a first arrangement of the mobile columns, FIG. 5 shows the same lifting system in the same view and condition in FIG. 4, in a second and different arrangement of the mobile columns, FIG. 6 shows a first screenshot displayed on the display apparatus of the interface of the mobile column according to the invention, FIG. 7 shows the symbols indicating the different operating modes of the column, FIGS. 8, 9 show the corresponding screenshots of the display apparatus of the interfaces of two mobile columns which define a group of two columns which are simultaneously controllable, and FIG. 10 shows the screenshot displayed in the display apparatus for displaying/controlling the mutual alignment of the lifting means of the columns, FIG. 11 shows a perspective view of a third embodiment of the lifting system according to the invention, positioned about a load but prior to the lifting thereof, FIG. 12 shows a perspective view of the lifting system in FIG. 11, during the lifting of the load, FIG. 13 shows a screenshot of the display apparatus of a mobile column which forms part of the lifting system in FIG. 11.

As shown in the drawings, system 2 according to the invention, for lifting a load, preferably of a motor vehicle, comprises two or more mobile columns 4 which substantially are mechanically and structurally of traditional type.

Conveniently, in the embodiments depicted in FIGS. 3 to 5, the lifting system 2 is defined by four mobile columns 4, however it is understood that such a system may also comprise two columns alone, or six, or eight or more, depending on the number of wheels of the motor vehicle to be lifted.

In particular, as depicted in FIGS. 1 and 2, each mobile column 4 according to the invention comprises a vertical support structure 6 along which lifting means slide vertically comprising a carriage 8 provided with horizontal arms 9 intended to engage predetermined areas of the motor vehicle to be lifted.

In particular, the vertical support structure 6 is provided at the bottom with means, for example a carriage with wheels 7, for the moving thereof within the work premises.

Column 4 is also provided with actuation means 3, of the electromechanical or hydraulic type, for moving the lifting means 8 and 9 along the vertical support structure 6, and also with a control unit and a user interface 12.

In particular, the user interface 12 comprises a display apparatus 13 and a configuration panel provided with input means which are operatively activable by the user. For example, the user interface 12 comprises a touch screen and/or a display monitor associated with a keyboard/push-button panel.

Furthermore, column 4 is provided with an electromechanical stop 14 for stably blocking the vertical movement of carriage 8 with respect to the vertical support structure 6.

The mobile columns 4 of system 2 communicate with one another via cable and/or wirelessly.

As depicted in FIG. 3, before the positioning of the mobile columns 4 about the vehicle, the columns themselves are conveniently gathered, in a casual manner and without any particular positioning sequence, at a space 15 of the work premises, for example of the workshop. Advantageously, in such a non-operating condition, the mobile columns 4 are particularly close to one another so as to optimize and minimize the overall volume thereof within the work premises.

Therefore, to set up and create a lifting system 2 from a plurality of mobile columns 4, the user performs the following operations in sequence.

Advantageously, the user may set up and create a lifting system 2 in which there are registered a number of mobile columns 4 equal to, or possibly also greater than, that required for the specific need and application thereof. For example, to lift the vehicle 11 depicted in FIGS. 4 and 5, the user determines that there is a need for four mobile columns 4, one for each wheel of the vehicle 11.

In particular, to set up and create the lifting system 2, the user positions himself, one after the other and without any predefined order, at the user interface 12 of each mobile column 4 which is intended to be registered as belonging to system 2 and which, conveniently, is selected from those present within the work space 15.

Therefore, for each column, the user acts on an activation command which is provided on the corresponding user interface 12 of each of such columns so as to register them as belonging to the lifting system 2 that he is setting up. In particular, by acting on such an activation command, the user activates the column without setting up and defining any relationship regarding the mutual position of such a column with respect to the other columns, regarding the positioning thereof with respect to the load 11 to be lifted and regarding the positioning sequence thereof with respect to the load 11 to be lifted.

Advantageously, the activation command for registering the columns 4 in the lifting system 2 is a control which indicates/represents the number of columns forming the system itself (for example, in the example disclosed, the user may set up the number "four" in all columns).

Advantageously, the activation command for registering the columns 4 in the lifting system 2 allows a unique identification code (e.g. a number) to be selected, set up and associated with each column. Conveniently, such a unique identification code is associated with each column by the user acting directly on the user interface 12 of the corresponding column (that is, it is not created and associated automatically by the system itself or by the processing unit of each column). In particular, such a unique identification code is independent from, and unrelated to, the sequence with which the user registers each column in the lifting system 2; therefore for example, column 4, which is registered first in the lifting system 2, may be selected and associated by the user with the numeric identification code corresponding also to the numbers "three" or "two" or also "one".

Advantageously, the activation command of each column 4 on the user interface 12 of each of said columns 4 is configured and arranged so as not to provide and/or be associated with any information and depiction in relation to the position of the columns 4, both from one another and in relation to said load 11 to be lifted. In other words, the activation command is independent from, and unrelated to, a graphic and/or information viewpoint with respect to the position of the columns 4, both from one another and with respect to the load 11 to be lifted.

Then, one by one the user picks the columns 4 which were registered as belonging to system 2 and positions them in any order and in any case free from any position relationship between the columns or with respect to the load, at the wheels 17 of vehicle 11 to be lifted or of the operating areas provided for lifting any load.

It is understood that the registration of the columns 4 and the lifting system 2 also may be performed after the positioning thereof at the wheels 17 of vehicle 11 or of the operating areas provided for lifting any load. In particular, also in this case, such a positioning occurs in any order and is, free from any position relationship of the columns, both from one another or with respect to the load.

In particular, as shown from the comparison between FIG. 4 and FIG. 5, each column 4 of the lifting system 2 thus created may be positioned in any operating position with respect to vehicle 11. Indeed, column 4' may be for example, positioned at the front right wheel 17' of vehicle 11 (see FIG. 4) or at the rear right wheel 17" of the same (see FIG. 5), just like column 4" may be for example, positioned at the rear right wheel 17" of vehicle 11 (see FIG. 4) or at the front right wheel 17" of the same (see FIG. 5).

This is particularly advantageous because it allows shortening the work times if a lifting system 2 with four columns 4, which was already set up and used for lifting a first vehicle, is to be used again and repositioned for lifting a second vehicle. In particular, the setting up/creation of the lifting system 2 according to the invention allows that once such a system has been used for lifting a first load, it may then be used again and repositioned freely for lifting a second load, and this without any relationship concerning the picking order of the individual columns and/or of the operating positioning thereof, both from one another and with respect to the second load.

In particular to this end, the software loaded onto the control unit of each column 4 is configured to define a lifting system 2 in which only the number of components of such a system is set up, without setting up and defining any relationship regarding the mutual position thereof, the position thereof with respect to the vehicle to be lifted and/or the positioning/activation sequence thereof. In greater detail, to do this, advantageously said software is configured to connect and couple all the columns of the system to one another so that each column may communicate with all the others. This is different with respect to the prior art in which the lifting system instead consists of several pairs of columns, each of which consists of transversely aligned columns which are connected and coupled to one another two-by-two.

Once all the columns 4 of the lifting system 2 have been positioned at the wheels 17 of vehicle 11, or at the suitable operating area, the user positions himself at one column 4 of the lifting system 2 and, by acting on the user interface 12 thereof, assigns to said column the role of command column of the others, which therefore become controlled columns.

Therefore, by acting on the user interface 12 of the command column, the user commands the simultaneous lifting/lowering of at least one or all the columns of the system, or possibly also of a group thereof which consists only of some of the columns registered in such a system 2, as will be more apparent below.

Conveniently, the control unit of each column 4 in system 2 according to the invention is configured to communicate with all the others, preferably according to a predetermined sequence and always with the same priority. Furthermore, the control unit of each column 4 is configured to control that a number of columns 4 has been activated corresponding to that initially set up by the user on each column of the system.

Advantageously, in system 2 according to the invention, once the number of columns forming part of the lifting system 2 has been set up in each column 4, the user may pick, reposition and activate the columns 4 forming part of the system itself in any order. For example, the columns 4 of system 2 may be picked, repositioned and/or activated in the sequence providing first for column 4', then column 4", then 4'" and finally 4"", but the same columns of the system could be picked, repositioned and/or activated also in any other sequence (for example, first column 4"", then column 4'", then 4" and finally 4').

Interface 12 of each column 4 is configured so as not to provide the user with any information, by means of the interface itself, regarding the position of the column on which the user is acting, both in relation to the other columns and to the load 11 to be lifted. Preferably, no depiction of the position of the columns 4 from one another and with respect to the load 11 to be lifted is provided on the graphic interface 12 or, in any case, the indicators provided both for controlling the columns 4 and for displaying them are independent and disconnected from the depictions of each column 4 and of load 11.

Preferably, the display apparatus 13 of the graphic interface 12 indicates:

- the number of columns 20 which are connected to one another, and that is registered as belonging to the lifting system 2, and
- a code t22 which uniquely identifies each column and is manually set up by the user himself by actively and manually acting on the input means of the graphic interface 12.

Preferably, the codes 22 which uniquely identify the columns 4 within the lifting system 2 created or being created are numerical or alpha-numerical and are progressive. Preferably, such codes 22 are arranged in ordered sequence, one after the other, preferably aligned horizontally and/or vertically.

Preferably, screenshot 19, as depicted in FIG. 6, which is displayed on the display apparatus 13 of interface 12 of each column 4, comprises:

- the indication 20 of the number of columns which the user has set up as forming part of the lifting system 2,
- the codes 22 which uniquely identify the columns 4 within the lifting system 2 created during the creation step,
- a first number 24 that indicates the actual height of column 4 and a second number 26 that indicates the maximum height achievable thereby,
- a first graphic depiction 28 which indicates the operating/activation mode set up for that column 4,
- a second graphic depiction 30 which indicates if column 4 is set up as a command column or as a column controlled within the lifting system 2 or a working group thereof,
- a third graphic depiction 32 which, in the case of a touch screen, indicates an area thereof to click on to enable/disable the screen lock,
- a fourth graphic depiction 34 which indicates if the electromechanical stop 14, which stably locks the vertical movement of carriage 8 with respect to the vertical support structure 6, is or is not in an activated position on all the columns 4 of the lifting system 2, a fifth graphic depiction 36 which indicates that the corresponding column is stationary.

Advantageously, there likewise may be provided a code 23 on the display apparatus 13 which identifies the column 4 on which interface 12 the user is acting and which substantially corresponds to code 22 which the user has set up/associated with such a column.

Advantageously, there likewise is provided a further graphic depiction 41 on the display apparatus 13 which indicates the type of vehicle or load 11 and which is always unrelated to and independent from the aforesaid indication 20 and the aforesaid codes 22, both in terms of graphics and in terms of information. Preferably, such a graphic depiction 41 is configured so as to depict only the number of lifting operating areas required for that type of load. In particular, in the case of a vehicle, the graphic depiction 41 is such so as to note the number of axles of such a vehicle.

Conveniently, the display apparatus 13 comprises an individual screenshot 19, which has:

- a first portion 43 within which there are displayed in sequence, the unique identification codes 22, each corresponding to a column 4 of the lifting system 2, which are vertically and/or horizontally aligned, and which are manually associated by the user by acting on the input means of the graphic interface 12, and
- a second portion 45 within which there is displayed the graphic depiction 41 of the load 11 to be lifted; the second portion 45 is separate, independent and disconnected from the first portion 43, both in terms of graphic display and in terms of information.

Advantageously, there are also provided on the display apparatus 13, further symbols 38, 40 and 42 for indicating the language used, the charge status of the battery of column 4 and the entity of the Wi-Fi signal for connecting the columns to one another, respectively.

Conveniently, the enabled or disabled status of each indicator and/or the graphic depiction with which it is displayed on the screen may be defined by means of suitable symbols and/or different colors.

Preferably, the enabled or disabled status of the codes 22 allows the user to be informed on the number of columns already connected to one another to define the lifting system 2 and/or on the number of columns still to be connected to the others to complete such a system.

Conveniently, the user may click on the touch screen monitor 13 at the various indicators and/or graphic depictions provided or may act on the keyboard or on another suitable input device associated with column 4, to interact with the interface 12 of column 4 and send input controls aiming to modify the status of the column itself.

Advantageously, the software of the control unit of each column 4 is configured so that when the user acts on interface 12 of a column (for example, by clicking on the second graphic depiction 30) so as to set up the same as a command column within the lifting system 2, the other columns of the system are automatically set up as controlled columns.

Conveniently, the columns 4 of system 2 are always in communication with one another however, once a control column has been set up, the software of the control unit of each column 4 is configured so that only the command column may send active controls to the others.

As is apparent from FIGS. 6, 8, 9 and 13, screenshot 19 displayed on the screen 13 of interface 12 does not provide any graphic depiction which indicates/provides information regarding the position of that column 4 on which the user is acting, with respect to vehicle 11 and/or with respect to the other columns of system 2.

The first graphic depiction 28 on screenshot 19, that is that indicating the operating/activation mode set up for that column 4, may comprise one of the symbols depicted in FIG. 7, and in particular:

- a first symbol 44 for setting up/indicating, within the columns forming part of the lifting system 2, a group consisting of an individual column on which the user is acting,
- a second symbol 46 for setting up/indicating, within the columns forming part of the lifting system 2, a group consisting only of two columns, and in particular of that on which the user is acting and of any other column forming part of system 2,
- a third symbol 48 for setting up/indicating an operating mode in which all four columns of the lifting system 2 are active.

Once the lifting system 2 has been created and set up, the user may have the need to create a group consisting only of one or two columns 4, among all the columns 4 forming part of system 2.

To do this, the user positions himself physically and in sequence at each of the columns 4 of the group to be defined so as to then act on the corresponding user interface 12.

In particular, to set up the system so as to allow the simultaneous activation of a group consisting of the two columns 4', 4" alone, from among the four forming part of system 2, the user acts in the following manner:

- he positions himself at the first column 4' and acts on interface 12' (see FIG. 8) firstly by clicking on the graphic depiction 28' of screenshot 19' so as to display symbol 46' and thus set up the operating mode on column 4' in which only one group consisting of two columns is activated; then, by clicking on the graphic depiction 30' of screenshot 19', the user sets up the first column 4' as the controlled column of the group,
- he then positions himself at column 4" and acts on interface 12" (see FIG. 9) firstly by clicking on the graphic depiction 28" of screenshot 19" so as to display symbol 46" and thus set up the operating mode on column 4" in which only one group consisting of two columns is activated; then, by clicking on the graphic depiction 30" of screenshot 19", the user sets up column 4" as the command column of the group.

Conveniently, as is apparent from the comparison between FIGS. 8 and 9, the graphic depiction 30' which identifies a controlled column is different, for example in terms of colors, from the graphic depiction 30" which identifies the command column.

It is understood that such a configuration step may be performed by the user by first acting on column 4' intended to become the controlled column and then by acting on column 4" intended to become the command column of the group, or also vice versa.

Once such a configuration of the group is performed, the user positions himself at interface 12" of the command column 4" to command the simultaneous movement of the respective lifting carriages 8' and 8" of the columns 4', 4" of the group thus defined.

If the columns 4', 4" of the group created are aligned transversely to vehicle 11, the activation thereof allows lifting the latter at the axle thereof for example, to perform maintenance operations.

If the columns 4', 4" of the group set up instead are both arranged on the same side of vehicle 11, the activation thereof allows laterally tilting the same, for example, to empty a tank mounted on board.

Conveniently, according to the embodiment depicted in FIGS. 11 to 13, the lifting system 2—but this also applies to a lifting unit defined within such a system—is defined by three mobile columns 4, however it could be defined by any other odd number of mobile columns 4 (that is, five, seven, etc.). In particular, in such a case all the mobile columns 4 are conveniently arranged about the center of the load 11 to be lifted. Advantageously, the creation/set-up of a lifting system 2 or of a lifting unit with an odd number of mobile columns 4 may be obtained due to the fact that once each column 4 is registered as belonging to system 2, it communicates with all the other columns 4 registered in the system itself. In particular, the lifting system 2 of the embodiment in FIGS. 11 to 13 is set up and controlled by means of the same procedure described above with reference to the other embodiments. Moreover, as shown in FIG. 14, screenshot 19 of the display apparatus 13 of the graphic interface 12 of each column 4 of the lifting system 2, which consists of an odd number of mobile columns 4, has the same essential and preferential features described above with reference to the other embodiments.

Conveniently, the lifting system according to the invention may comprise two or more mobile columns 4 which are positioned about the load 11 to be lifted so as not to be opposite, in the sense that they may be positioned at operating areas provided for lifting load 11 which are not mutually opposite with respect to a reference axis that crosses the load itself.

Furthermore, system 2 according to the invention is also configured, during the operation thereof, to control, display and adjust the vertical alignment between the lifting carriages 8 of the columns 4 of system 2 or of the working group.

In particular, each column 4 is provided with means for detecting the height of each lifting carriage 8 and moreover, the control and processing unit of each column 4 is configured to receive the height value detected by said means and to compare whether it corresponds with, or is within a predefined tolerance range of, that of the lifting carriages 8 activated in the other columns 4.

Moreover, if it is detected that the lifting carriages 8 of one or more columns 4 are misaligned in height with respect to those of the others, the control and processing unit is configured to block the movement of the lifting carriages 8 of all the other columns and to display a suitable warning signal for the user on the display apparatus 13 of interface 12. Preferably, such a warning signal is displayed on the display apparatus 13 of the command column on which the user is acting, and also indicates which column has the lifting carriage 9 misaligned in height with respect to those of the other columns.

Therefore, with respect to such a warning, the user positions himself physically at the column with carriage 8 misaligned and acts on interface 12 so as to display a screenshot 50 on the corresponding display apparatus 13 indicating the height of all the carriages 8 of the columns 4 of the system/group.

In greater detail, screenshot 50 comprises:

- graphic symbols 52', 52", 52''', 52'''', for example dot-shaped symbols, each of which represents the lifting carriages 8 of the columns 4 of the lifting system 2,
- a line 53 which indicates the alignment plane of the lifting carriages 8 of the columns of the system,
- two areas 54 and 56 which are a non-tolerance area and a tolerance area, respectively, for the alignment between the carriages of the columns.

For example, alignment screenshot 50 (see FIG. 10) indicates that the first dot 52', corresponding to carriage 8 of the first column 4' of the work system, is misaligned with respect to line 53 which joins the three dots 52", 52''', 52'''' corresponding to the carriages 8 of the other three columns 4, and is in the non-tolerance area 54.

By acting on interface 12 of the column with the misaligned carriage, the user commands the vertical movement of the carriage of such a column to allow the vertical realignment thereof with respect to the others, which in the meantime remain stationary.

Advantageously, during the automatic realignment step, the user may display and follow in real time the automatic realignment step of the lifting carriage 8 while watching dot 52'—which dot represents the misaligned carriage—on the alignment screenshot 50 move so as to align itself with the other dots indicating the carriages 8 already aligned with one another.

It is apparent from above that the procedure, the mobile column and the lifting system according to the invention are more advantageous than the traditional ones, because:

- the positioning or repositioning sequence of the columns about the load or the vehicle is completely random and free, and this is due to the fact that no relationship related to the positioning of the columns from one another and with respect to the vehicle is forced or defined during the step of registering the columns in the system,
- this allows a lifting system or a lifting unit consisting of an odd number of columns, to be defined,
- depending on needs, they allow lifting sub-groups defined by any two columns to be set up, the work axis of which is conveniently selected by the user,
- they allow controlling the alignment status of the columns and, in the case of misalignment of one of them, allow the automatic realignment thereof, and also allow the user to visually control the performance of such an operation.

The invention claimed is:

1. A method for setup and control of a system for lifting loads, said system comprising a plurality of mobile lifting columns (4) configured to be activated simultaneously, said method comprising the following steps performed by a user:

- having the user positioned at each of said columns (4) to be registered, successively and in any order, as belonging to said system;
- having the user provide at least one activation command in a user interface (12) of each of said columns (4), for registering said columns as belonging to said system without setting and defining any relationship in regard to a mutual position of the columns, to operating positions of said columns with respect to a load (11) to be lifted, and to a positioning sequence of said columns with respect to the load (11) to be lifted, the user interface (12) of each of said columns (4) being configured so as to not provide to the user any information, by way of said user interface (12), regarding the position of one of the plurality of columns, on which the user is acting, in relation to other columns of the plurality of columns and to the load (11), the user further providing each of said columns (4) with a unique identifier;

moving physically, in any order, each registered column (4) to locate said registered column at any of the operating positions (17) provided for lifting said load (11);

having the user positioned at any one of the registered columns (4) and, by acting on the user interface (12) of the any one of said registered columns, assigning to the any one of said registered columns a role of command column of the other columns of said system; and commanding, by acting on the user interface (12) of the command column, a simultaneous lifting or lowering of at least one or all the columns of said system, wherein said at least one activation command includes an indication of a number of columns (4) intended to form part of said system (2), wherein said at least one activation command of each column (4) within the user interface (12) of each of said columns (4) is configured not to provide or be associated with any information and depiction in relation to the position of the columns (4) both from one another and in relation to said load (11) to be lifted, wherein by acting on said at least one activation command, the user sets up and defines the number of columns (4) intended to form part of said system (2), and wherein, by acting on the user interface (12) of each column (4), the user selects and sets up the unique identifier to be associated with each of said columns (4), said unique identifier of each column being associated with said columns (4) irrespective of the positioning sequence with which the user registers each column in said system (2), further comprising the step of providing each column (4) with a display apparatus in said user interface that displays a screenshot showing, indicators of the number of columns which the user has set up as forming part of the system, and codes corresponding to the unique identifiers of the columns.

2. The method according to claim 1, wherein the indicators in said user interface (12) representing each column (4) are configured and arranged not to provide, through said user interface (12), any information regarding the position of the column on which the user is acting, with respect both to the other columns and to the load (11) to be lifted.

3. The method according to claim 1, further comprising the following steps for defining, among the plurality of columns belonging to said system (2), a group of at least two columns (4', 4") which are configured to be activated simultaneously:

having the user positioned at a first column (4') of the at least two columns of the plurality of columns intended to form part of said group, and by acting on the user interface (12') of said first column (4'), sets having the user set up an operating mode wherein the group of at least two columns, is active;

having the user positioned at a second column (4") of the at least two columns of the plurality of columns intended to form part of said group, and by acting on the user interface (12") of said second column (4"), having the user set up the operating mode wherein the group is active;

having the user interact on the user interface (12', 12") of one of said first or second columns (4', 4") to assign, to the one of the first or second columns, the role of command column of the other one of the first or the second columns of the group; and having the user command, by acting on the user interface (12) of the command column, a simultaneous lifting or lowering of the at least two of the columns of the group thus defined.

4. The method according to claim 3, wherein said group comprises the two columns aligned transversely with respect to the load (11) to be lifted, or wherein said group comprises the at least two columns both arranged on a same side of the load (11) to be lifted.

5. A system (2) for lifting loads, the system comprising a plurality of mobile lifting columns (4) which are configured to be activated simultaneously, each of said mobile columns (4) comprising:

a support structure (6);

lifting members (8, 9) sliding vertically along said support structure and configured to engage a load to be lifted;

an actuator for said lifting members (8, 9);

devices moving the support structure (6) on a work surface for a correct positioning of the mobile lifting column (4) with respect to the load (11) to be lifted;

a user interface (12);

a control unit;

elements for communication and functional connection of the control unit with the other ones of the mobile lifting columns (4) of the system; and software loaded and executed in the control unit, the software being configured to perform the following steps:

receiving an activation command and a unique identifier from the user interface for registering the mobile lifting column as belonging to said system without setting and defining any relationship in regard to respective locations of the mobile lifting column and the other ones of the mobile lifting columns and to an operating position of said mobile lifting column with respect to the load;

based on user input, assigning to said mobile lifting column a role of command column of the other ones of the mobile lifting columns of said system; and commanding, based on the user input received from the user interface, a simultaneous lifting or lowering of the mobile lifting column and the other ones of the mobile lifting columns, wherein the user interface comprises a display apparatus, wherein the display apparatus (13) of the user interface (12) does not provide any information concerning the respective locations of the columns from one another, and wherein the display apparatus (13) comprises a screenshot which has:

a first portion (43), inside of which there are displayed in sequence, a series of unique identification codes (22), each corresponding to one of the plurality of the mobile lifting columns, the identification codes being vertically or horizontally aligned, and a second portion (45), which is separate and independent from said first portion (43), and inside of which there is displayed a graphic depiction of said load (11) to be lifted.

6. The system according to the claim 5, wherein said software is configured to put into communication and to functionally connect all the columns (4) to one another, which were registered as forming part of the system (2).

7. The system according to claim 5, wherein said user interface (12) comprises a panel adapted to configure the mobile lifting column (4), the panel being provided with input elements adapted to be activated to register said column (4) as belonging to said system (2), without defining or setting up any relationship concerning a position of said column (4) with respect to the columns or regarding the load (11) to be lifted.

8. The system according claim 5, wherein said display apparatus (13) of said user interface (12) comprises a graphic depiction (20) indicating how of the many columns (4) are already connected to one another to define said system (2), or how many of the columns are still to be connected to the others to complete said system (2).

9. The system according to claim 5, wherein said display apparatus (13) of said user interface (12) comprises a graphic depiction (34) indicating if an electromechanical stop (14), which stably blocks a vertical movement of the lifting members (8) with respect to the support structure (6), is in a same status in all the columns (4) of the system (2).

10. The system according to claim 5, wherein said display apparatus (13) of said user interface (12) comprises a graphic depiction, which indicates or signals that the lifting members (8) of the column (4) of the system (2) or of a working group are misaligned in height with respect to the lifting members of the other ones of the plurality of mobile lifting columns, and wherein said display apparatus (13) further comprises a signaling of the identification code (22) of the column (4) having said lifting members (8) which are misaligned in height with respect to the lifting members of the other ones of the plurality of mobile lifting columns.

11. The system according to claim 10, wherein said display apparatus (13) of said user interface (12) comprises the screenshot (50) with a plurality of graphic symbols (52', 52", 52'", 52""), one for each column (4) of the system (2) or of the working group, which are arranged on the display apparatus (13), so as to graphically note a possible column which has the lifting members (8) misaligned in height with respect to the lifting members of the ones of the plurality of mobile lifting columns.

12. The system according to claim 11, wherein during a step of automatic realignment of the lifting members (8) of the mobile lifting columns (4) of the system (2) or of the working group, a position of one of the graphic symbols (52) representing the column having the lifting members (8) misaligned in height with respect to the lifting members of the other ones of the plurality of mobile lifting columns, is updated in real time in said screenshot (50) of said display apparatus (13) of said user interface (12).

13. A system (2) for lifting loads comprising:

a plurality of mobile lifting columns (4), each comprising:

a support structure (6);

lifting members (8, 9) sliding vertically along said support structure and configured to engage a load to be lifted;

an actuator for said lifting members (8, 9);

devices moving the support structure (6) on a work surface for a correct positioning of one of the columns (4) with respect to the load (11) to be lifted;

a user interface (12);

a control unit;

elements for communication and functional connection of the control unit with the other columns (4); and a software loaded and executed in the control unit, said plurality of the mobile lifting columns being adapted to be activated simultaneously, wherein the software is configured to perform the following steps:

receiving an activation command and a unique identifier from the user interface for registering each of the plurality of the mobile lifting columns as belonging to said system;

based on user input, assigning to one of the plurality of the mobile lifting columns a role of command column of the other one of the plurality of the mobile lifting columns of said system; and commanding, based on the user input received from the user interface, a simultaneous lifting or lowering of the one of the columns and the other columns, and wherein the software loaded and executed on said control unit and the user interface (12) of each of the plurality of the mobile lifting columns (4) of said system (2) are further configured to allow a user to register each of said plurality of the mobile lifting columns (4) as belonging to said system (2), without setting up and defining any relationship regarding respective locations of the columns of said system, regarding a positioning thereof with respect to the load (11) to be lifted, or to a positioning sequence of the columns with respect to the load (11) to be lifted, and wherein the user interface comprises a display apparatus that displays a screenshot showing, indicators of the number of columns which the user has set up as forming part of the system, and codes corresponding to the unique identifiers of the columns.

14. The system (2) according to claim 13, wherein the software loaded and executed on said control unit and the corresponding user interface (12) of each column (4) are configured to allow the user to define, with an input device, a group of the mobile lifting columns liftable simultaneously, said group comprising at least any two of the columns (4) from among the plurality of the mobile lifting columns forming part of said system (2).

15. The system (2) according to claim 13, wherein the system has an odd number of the mobile lifting columns (4) or comprises, among the plurality of the mobile lifting columns (4) forming part of said system (2), a group of the mobile lifting columns (4) which are adapted to be lifted or lowered simultaneously, said group having an odd number of the mobile lifting columns (4).

16. The system (2) according to claim 13, wherein the system comprises the plurality of the mobile lifting columns (4) which are intended to be positioned about said load (11) to be lifted so as not to be opposite to each other.

* * * * *